US008540335B2

(12) United States Patent
Nakano et al.

(10) Patent No.: US 8,540,335 B2
(45) Date of Patent: Sep. 24, 2013

(54) PRINTING APPARATUS

(75) Inventors: Yasushi Nakano, Inagi (JP); Hajime Kaneko, Kodaira (JP)

(73) Assignee: Canon Kabushiki Kaisha, Tokyo (JP)

( * ) Notice: Subject to any disclaimer, the term of this patent is extended or adjusted under 35 U.S.C. 154(b) by 903 days.

(21) Appl. No.: 11/941,352

(22) Filed: Nov. 16, 2007

(65) Prior Publication Data

US 2008/0122891 A1 May 29, 2008

(30) Foreign Application Priority Data

Nov. 28, 2006 (JP) ..... 2006-320871

(51) Int. Cl.
*B41J 2/165* (2006.01)

(52) U.S. Cl.
USPC ..... 347/19

(58) Field of Classification Search
None
See application file for complete search history.

(56) References Cited

U.S. PATENT DOCUMENTS

| | | | | |
|---|---|---|---|---|
| 4,489,335 | A * | 12/1984 | Watanabe et al. | 347/19 |
| 6,951,382 | B2 * | 10/2005 | Inui et al. | 347/37 |
| 7,014,286 | B2 | 3/2006 | Yonekubo | |
| 7,182,420 | B2 * | 2/2007 | Nakazawa | 347/7 |
| 2001/0055041 | A1 | 12/2001 | Yonekubo | |
| 2003/0112286 | A1 * | 6/2003 | Shindo | 347/30 |
| 2005/0195236 | A1 * | 9/2005 | Suzuki et al. | 347/19 |

FOREIGN PATENT DOCUMENTS

JP 2002-234196 8/2002

* cited by examiner

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

A printing apparatus capable of specifying the color material concentration in ink can discharge or suck the ink in a suitable amount for suppressing degradation in print quality or ink supply failure. The printing apparatus executes printing by scanning a printhead having an orifice to discharge ink. The printing apparatus includes a scanning unit which scans the printhead without discharging the ink to generate a discharge failure orifice, and a detection unit which detects the presence of the discharge failure orifice. The color material concentration in the ink is estimated on the basis of the number of times or the time of scanning without discharging the ink required until the detection unit detects the presence of the discharge failure orifice.

5 Claims, 6 Drawing Sheets

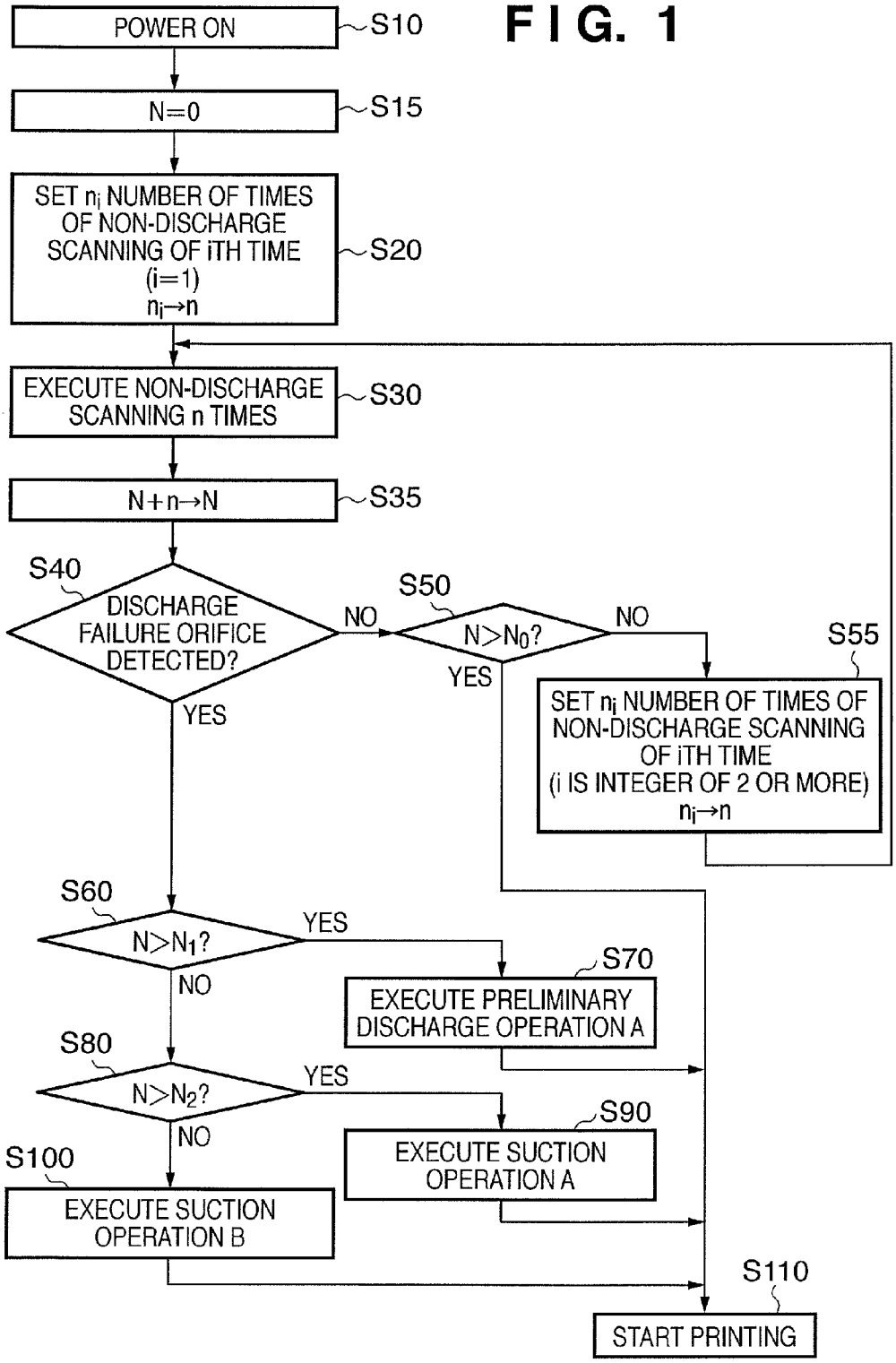
FIG. 1
POWER ON
S10
N=0
S15
SET $n_i$ NUMBER OF TIMES OF NON-DISCHARGE SCANNING OF iTH TIME (i=1) $n_i \rightarrow n$
S20
EXECUTE NON-DISCHARGE SCANNING n TIMES
S30
N+n→N
S35
S40
DISCHARGE FAILURE ORIFICE DETECTED?
NO
YES
S50
$N>N_0$?
NO
YES
S55
SET $n_i$ NUMBER OF TIMES OF NON-DISCHARGE SCANNING OF iTH TIME (i IS INTEGER OF 2 OR MORE) $n_i \rightarrow n$
S60
$N>N_1$?
YES
NO
S70
EXECUTE PRELIMINARY DISCHARGE OPERATION A
S80
$N>N_2$?
YES
NO
S90
EXECUTE SUCTION OPERATION A
S100
EXECUTE SUCTION OPERATION B
S110
START PRINTING

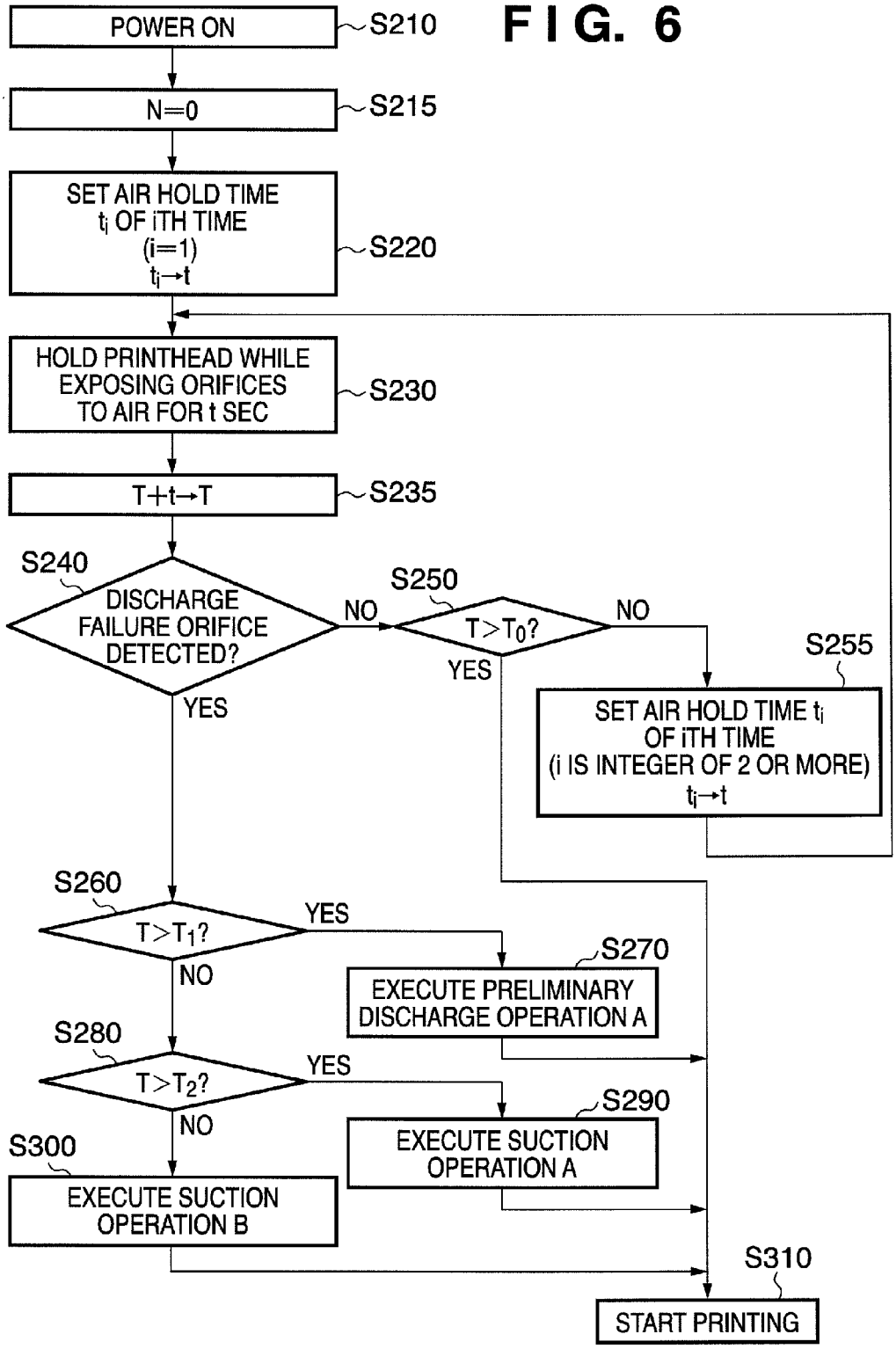
FIG. 6
POWER ON
S210
N=0
S215
SET AIR HOLD TIME
$t_i$ OF iTH TIME
(i=1)
$t_i \rightarrow t$
S220
HOLD PRINTHEAD WHILE
EXPOSING ORIFICES
TO AIR FOR t SEC
S230
T+t→T
S235
S240
DISCHARGE
FAILURE ORIFICE
DETECTED?
NO
YES
S250
$T>T_0$?
NO
YES
S255
SET AIR HOLD TIME $t_i$
OF iTH TIME
(i IS INTEGER OF 2 OR MORE)
$t_i \rightarrow t$
S260
$T>T_1$?
YES
NO
S270
EXECUTE PRELIMINARY
DISCHARGE OPERATION A
S280
$T>T_2$?
YES
NO
S290
EXECUTE SUCTION
OPERATION A
S300
EXECUTE SUCTION
OPERATION B
S310
START PRINTING

PRINTING APPARATUS

BACKGROUND OF THE INVENTION

1. Field of the Invention

The present invention relates to a printing apparatus capable of specifying the color material concentration in ink near the orifices of the printhead.

2. Description of the Related Art

An inkjet printing apparatus prints an image by repeating a main scanning operation of discharging ink from each orifice of the printhead while scanning the printhead in the main scanning direction and a conveyance operation of conveying a print medium such as a paper sheet in the sub-scanning direction perpendicular to the main scanning direction. Inks used in the inkjet printing apparatus are roughly classified into pigment inks and dye inks. There are inkjet printing apparatuses using only pigment inks, those using only dye inks, and those using both dye inks and pigment inks in accordance with the application purpose.

Each pigment ink or dye ink is contained in an ink tank serving as a container. When the ink tank is connected to the printhead, the ink can be supplied to the orifices serving as the ink discharge unit of the printhead. There is also an ink-tank-integrated printhead having an ink tank for storing inks. In this printhead, the ink tank communicates with the orifices and supplies the inks to the orifices.

The period (e.g., physical distribution period) until an ink tank or an ink-tank-integrated printhead is attached to an inkjet printing apparatus is variable. For this reason, ink in the ink tank or ink-tank-integrated printhead may physically or chemically change depending on the conditions such as the length of the physical distribution period or the temperature and humidity in that period. Especially in a pigment ink, the pigment, i.e., the color material, readily increases its particle size or settles due to coagulation, and the pigment concentration in the ink may have a distribution. Even after the ink tank or ink-tank-integrated printhead is attached to the inkjet printing apparatus, the ink may have a concentration distribution depending on the conditions such as temperature and humidity, and how long the inkjet printing apparatus has been sitting idle in that period.

Ink with a concentration distribution may partially have, near the orifices, a pigment concentration more than a predetermined value. Discharge of the ink with a pigment concentration more than a predetermined value is unstable. Hence, the quality of an image printed on a print medium may degrade. Alternatively, when an orifice or an ink channel communicating with it is clogged with the ink with a pigment concentration more than a predetermined value, an ink supply failure may occur. Even a dye ink may have the same problems when the ink in the ink tank or ink-tank-integrated printhead evaporates, and a concentration distribution is generated in the dye or solvent.

Conventionally, techniques of forcibly discharging or sucking ink from orifices are known as solutions to the problem of poor print quality or ink supply failure caused by the concentration distribution in ink. These techniques of forcibly discharging or sucking ink include, e.g., preliminary discharge for discharging ink not to contribute to image printing and a recovery operation such as a suction operation of causing a suction pump to forcibly suck ink near the orifices. It is preferable to discharge or suck ink in an amount corresponding to the pigment concentration at a portion with a pigment concentration more than a predetermined value without degradation in print quality or ink supply failure caused by a small ink discharging or sucking amount or conversely without wasteful ink discharging or sucking.

An inkjet printing apparatus described in Japanese Patent Publication Laid-Open No. 2002-234196 can suck a suitable amount of ink by changing the amount of suction by a suction pump in accordance with the elapsed time after an ink tank was attached to the inkjet printing apparatus.

However, in the method described in Japanese Patent Publication Laid-Open No. 2002-234196, the inkjet printing apparatus needs to separately have a mechanism for calculating the elapsed time after an ink tank was attached to the inkjet printing apparatus. Additionally, since the concentration distribution of a pigment in ink also changes depending on the conditions such as temperature and humidity, the arrangement that specifies the pigment concentration in ink on the basis of the elapsed time may cause an error in the actual pigment concentration in the ink. If such an error occurs, degradation in print quality or ink supply failure may be caused by a small ink discharging or sucking amount, or wasteful ink discharging or sucking may be caused by a large ink discharging or sucking amount.

SUMMARY OF THE INVENTION

The present invention is directed to a printing apparatus.

It is an object of the present invention to provide a printing apparatus capable of estimating the color material concentration in ink to discharge or suck a suitable amount of ink for suppressing degradation in print quality or ink supply failure.

According to one aspect of the present invention, there is provided a printing apparatus for executing printing by scanning a printhead having an orifice to discharge ink, comprising:

scanning means for scanning the printhead without discharging the ink to generate a discharge failure orifice; and detection means for detecting presence of the discharge failure orifice, wherein a color material concentration in the ink is estimated on the basis of one of the number of times and time of scanning without discharging the ink required until the detection means detects the presence of the discharge failure orifice.

According to another aspect of the present invention, there is provided a printing apparatus for executing printing by scanning a printhead having an orifice to discharge ink, comprising:

cap means for capping an orifice surface of the printhead;

holding means for holding, in air, the printhead separated from the cap means to generate a discharge failure orifice; and detection means for detecting presence of the discharge failure orifice, wherein a color material concentration in the ink is estimated on the basis of time of air hold required until the detection means detects the presence of the discharge failure orifice.

The invention is particularly advantageous since it is possible to estimate the color material concentration in ink to discharge or suck the ink without degradation in print quality or ink supply failure caused by a small ink discharging or sucking amount or without wasteful ink discharging or sucking caused by a large ink discharging or sucking amount.

Further features of the present invention will become apparent from the following description of exemplary embodiments (with reference to the attached drawings).

BRIEF DESCRIPTION OF THE DRAWINGS

FIG. 1 is a flowchart of a color material concentration specifying process according to the first embodiment;

FIG. 6 is a flowchart of color material concentration specifying process according to the second embodiment.

DESCRIPTION OF THE EMBODIMENTS

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

[First Embodiment]

Figure 2:
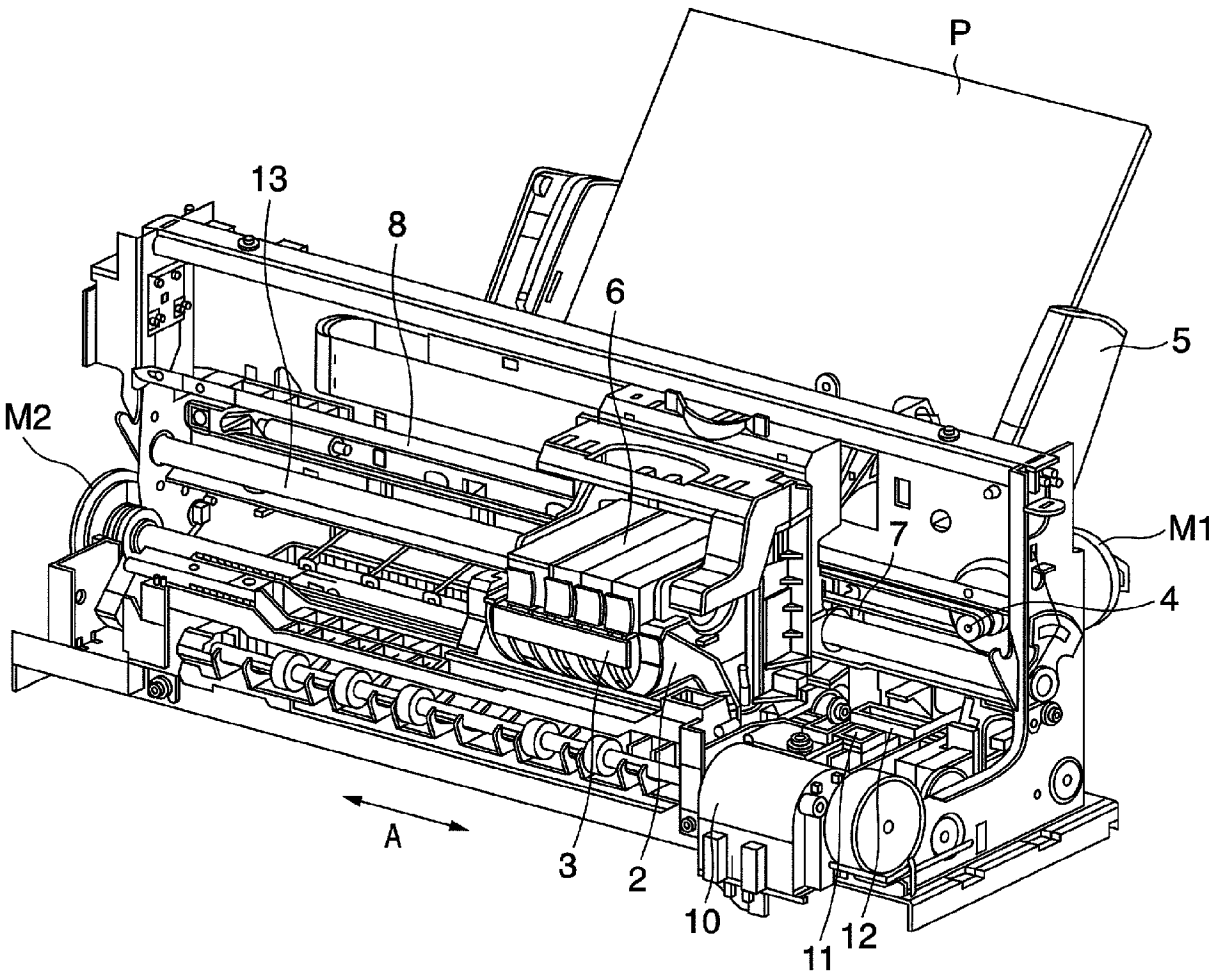
FIG. 2 is an external perspective view showing the arrangement of a printing apparatus.

FIG. 2 is an external perspective view showing the arrangement of an inkjet printing apparatus 1 to which the embodiment is applicable.

As shown in FIG. 2, the inkjet printing apparatus (to be referred to as a printing apparatus hereinafter) 1 has a printhead 3 which prints by discharging ink by an inkjet method. A carriage motor M1 generates a driving force, and a transfer mechanism 4 transfers it to a carriage 2 with the printhead 3 so that the carriage 2 reciprocally moves (reciprocally scans) in the main scanning direction, i.e., the direction of an arrow A. Together with the reciprocally scanning, a print medium P such as a printing paper sheet is fed via a paper feed mechanism 5 and conveyed to a print position. At the print position, the printhead 3 discharges the ink to the print medium P, thereby executing printing.

The carriage 2 of the printing apparatus 1 has not only the printhead 3 but also an ink tank 6 which contains ink to be supplied to the printhead 3. The ink tank 6 is detachable from the carriage 2.

The printing apparatus 1 shown in FIG. 2 can execute color printing. For this purpose, the carriage 2 has four ink tanks which contain magenta (M), cyan (C), yellow (Y), and black (K) inks, respectively. The four ink tanks are independently detachable.

The carriage 2 and printhead 3 can achieve and maintain necessary electrical connection by appropriately bringing their joint surfaces into contact. The printhead 3 receives energy in accordance with a print signal and selectively discharges ink from a plurality of orifices, thereby printing. Especially, the printhead 3 of this embodiment employs an inkjet method to discharge ink using thermal energy and therefore has electrothermal transducers. Electrical energy is applied to the electrothermal transducers and converted into thermal energy. When the thermal energy is applied to the ink, film boiling occurs, and the ink is discharged from the orifices by using a change in the pressure caused by growth/shrinkage of bubbles produced by the film boiling. The electrothermal transducers are provided in correspondence with the respective orifices. When a pulse voltage is applied to an electrothermal transducer in accordance with a print signal, a corresponding orifice discharges ink.

As shown in FIG. 2, the carriage 2 is coupled with a part of a driving belt 7 of the transfer mechanism 4 for transferring the driving force of the carriage motor M1 and guided and supported along a guide shaft 13 to be slidable in the direction of the arrow A. Hence, the carriage 2 reciprocally scans along the guide shaft 13 as the carriage motor M1 rotates in the forward and reverse directions. A scale 8 for indicating the position of the carriage 2 is provided along the main scanning direction (direction of the arrow A) of the carriage 2.

The printing apparatus 1 has a platen (not shown) that opposes the orifice surface of the printhead 3 with the orifices (not shown). The carriage 2 with the printhead 3 is reciprocally scanned by the driving force of the carriage motor M1. A print signal is simultaneously supplied to the printhead 3 to discharge ink so that the print medium P conveyed onto the platen is printed throughout its width.

The printing apparatus 1 has a recovery unit 10 for recovering a discharge failure of the printhead 3 at a position outside the range of the reciprocal motion (outside the print region) for the print operation of the carriage 2 with the printhead 3. An example of the position outside the print region is a position corresponding to the home position.

The recovery unit 10 includes a capping mechanism 11 for capping the orifice surface of the printhead 3 and a wiping mechanism 12 for cleaning the orifice surface of the printhead 3. In synchronism with orifice surface capping by the capping mechanism 11, a suction means (e.g., suction pump) in the recovery unit forcibly sucks the ink from the orifices. A discharge recovery operation is thus executed to, e.g., remove highly viscous ink or bubbles from the ink channels of the printhead 3.

In, e.g., a non-print mode, the capping mechanism 11 caps the orifice surface of the printhead 3 to protect the printhead 3 and prevent the ink from evaporating and drying. On the other hand, the wiping mechanism 12 located near the capping mechanism 11 wipes off the ink sticking to the orifice surface of the printhead 3.

The printing apparatus 1 can perform preliminary discharge by discharging the ink unrelated to printing to the capping mechanism 11.

The suction and preliminary discharge operations using the capping mechanism 11 and the wiper operation using the wiping mechanism 12 maintain the ink discharge state of the printhead 3 to be normal.

Figure 3:
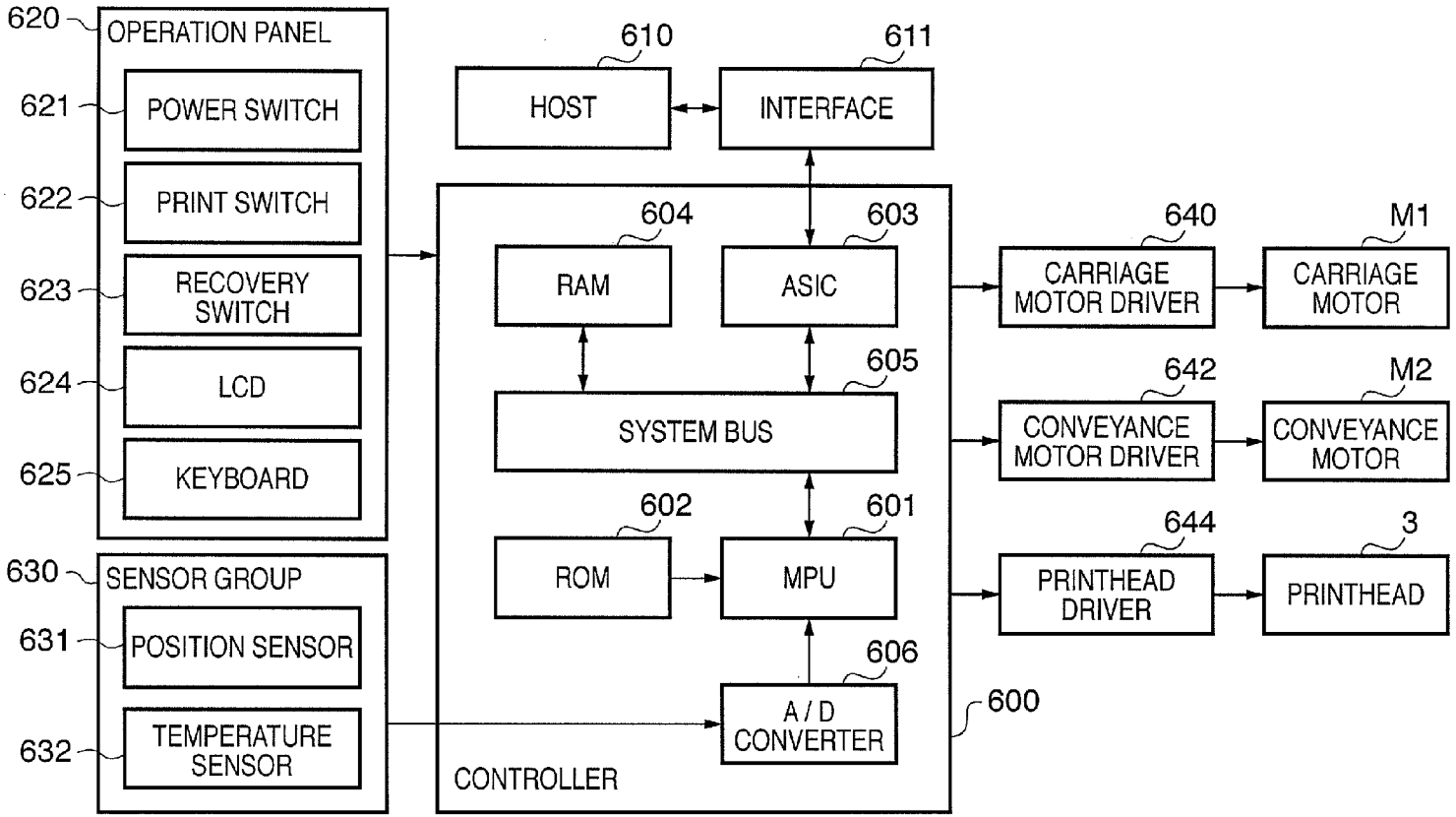
FIG. 3 is a block diagram showing the arrangement of the control circuit of the printing apparatus.

FIG. 3 is a block diagram showing the control arrangement of the printing apparatus 1 shown in FIG. 2.

As shown in FIG. 3, a controller 600 has an MPU 601 and a ROM 602 storing necessary tables and other permanent data. The ROM 602 also stores a program corresponding to a color material concentration specifying process (to be described later). When the MPU 601 executes this program, printhead scanning without ink discharge, i.e., so-called non-discharge scanning, can be performed. The MPU 601 is also designed to control discharging or sucking of ink near the orifices in accordance with the result of non-discharge scanning. The controller 600 also has an application specific integrated circuit (ASIC) 603 which generates control signals to control the carriage motor Ml, conveyance motor M2, and printhead 3. The controller 600 also has a RAM 604 that has an image data rasterization area and a work area for program execution, and a system bus 605 that connects the MPU 601, ASIC 603, and RAM 604 to each other and transfers data. The controller 600 also includes an A/D converter 606 which converts an analog signal received from a sensor group (to be described below) into a digital signal and supplies it to the MPU 601.

A computer serving as an image data supply source is called a host 610. The host 610 and printing apparatus 1 exchange image data, commands, and status signals via an interface (I/F) 611.

An operation panel 620 has switches to receive instruction inputs by the operator, including a power switch 621, a print switch 622 to instruct the start of printing, and a recovery switch 623 to instruct the start of a recovery operation. The operation panel 620 also has a keyboard 625 and a liquid crystal display (LCD) 624 to display various kinds of information. A sensor group 630 includes a position sensor 631 such as a photocoupler, and a temperature sensor 632. The operation panel 620 can set the number of times of non-discharge scanning or the non-discharge scanning time.

A carriage motor driver 640 drives the carriage motor M1. A conveyance motor driver 642 drives the conveyance motor M2. A printhead driver 644 drives the printhead 3.

In the arrangement illustrated in FIG. 2, the ink tank 6 is separated from the printhead 3. However, this embodiment is also applicable to a head cartridge that integrates an ink tank and a printhead.

Figure 4:
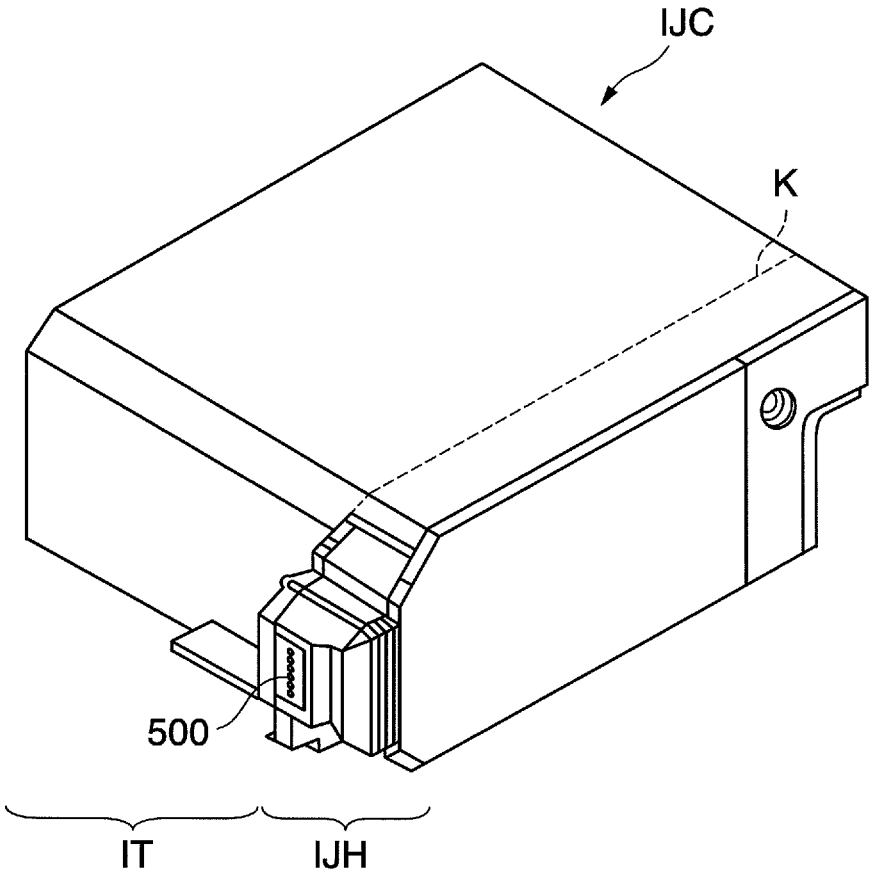
FIG. 4 is an external perspective view showing the arrangement of a head cartridge.

FIG. 4 is an external perspective view showing the arrangement of a head cartridge 100 that integrates the ink tank 6 and printhead 3. Referring to FIG. 4, a dotted line K indicates the boundary between the ink tank 6 and the printhead 3. An ink orifice array 500 has a plurality of orifices arrayed. Ink contained in the ink tank 6 is supplied to the printhead 3 through an ink supply path (not shown). The head cartridge 100 has an electrode (not shown) that receives a print signal supplied from the side of the carriage 2 when the head cartridge 100 is mounted on the carriage 2. On the basis of the print signal, the printhead 3 is driven to selectively discharge the ink from the orifices of the orifice array 500.

In this embodiment, the printhead 3 is scanned in the main scanning direction without discharging the ink from the orifices while exposing the orifices to air. That is, so-called non-discharge scanning is executed. On the basis of the number of times of non-discharge scanning until an orifice with a discharge failure (to be also referred to as a discharge failure orifice hereinafter) appears, the color material concentration (to be also referred to as the initial color material concentration hereinafter) of the ink near the orifices before non-discharge scanning is specified. The discharge failure orifice here indicates an orifice incapable of discharging ink or an orifice incapable of discharging ink in a set amount (the discharge amount is larger or smaller than a set amount). When non-discharge scanning is executed, the color material concentration increases due to evaporation of the ink near the orifices, and discharge failure orifices are generated.

Figure 5:
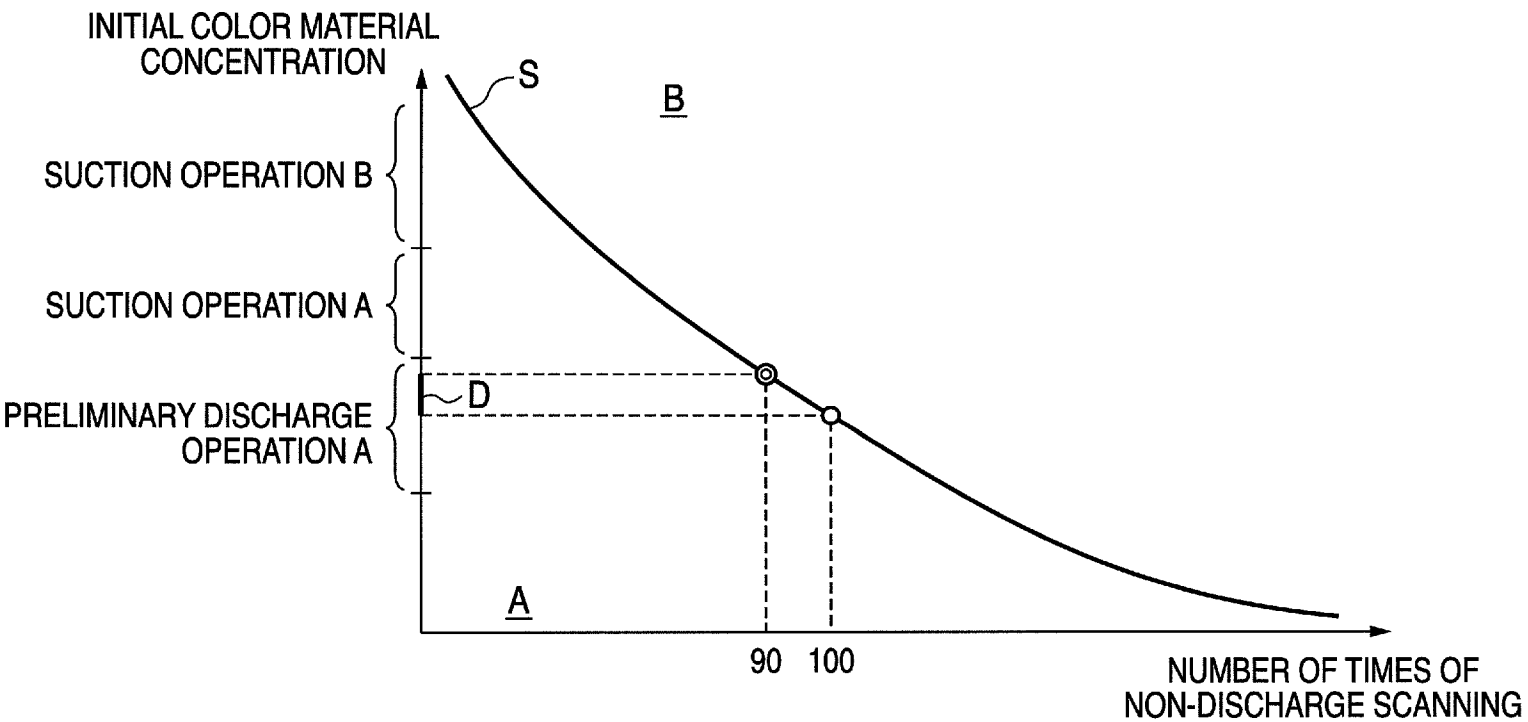
FIG. 5 is a graph showing the relationship between the number of times of non-discharge scanning and the initial color material concentration.

FIG. 5 is a graph showing the relationship between the number of times of non-discharge scanning and the initial color material concentration. The graph in FIG. 5 is divided into regions A and B by a curve S. In the region A, a discharge failure occurs in none of the orifices of the printhead 3. In the region B, a discharge failure occurs in at least one of the orifices of the printhead 3. The lower the initial color material concentration is, the more the ink near the orifices needs to be evaporated by executing a number of times of non-discharge scanning until a discharge failure orifice appears. Conversely, if the initial color material concentration is high, a discharge failure orifice appears even when the number of times of non-discharge scanning is small. That is, when the relationship between the number of times of non-discharge scanning and the initial color material concentration, as shown in FIG. 5, to generate a discharge failure orifice is obtained in advance by experiments and the like, the initial color material concentration can be specified (estimated) from the number of times of non-discharge scanning upon discharge failure orifice appearance.

For example, a printing apparatus is assumed to detect a discharge failure orifice in the printhead every time non-discharge scanning is executed 10 times. Although no discharge failure orifice is detected after non-discharge scanning is executed 90 times, a discharge failure orifice is detected after non-discharge scanning is executed 100 times. In this case, the initial color material concentration falls within a range D indicated by a bold line, as is specified from FIG. 5. The range of the initial color material concentration in ink near the orifices before execution of non-discharge scanning can be specified in this way. The color material concentration after execution of non-discharge scanning is not always constant independently of the initial color material concentration. As the initial color material concentration becomes low, the color material concentration after execution of non-discharge scanning becomes low. For this reason, when a recovery operation corresponding to the specified initial color material concentration range is performed, it is possible to prevent degradation in print quality or ink supply failure caused by a small ink discharging or sucking amount or wasteful ink discharging or sucking caused by a large ink discharging or sucking amount. That is, ink discharging or sucking in a suitable amount is possible. To do this, for example, a plurality of recovery operations (preliminary discharge operation A, suction operation A, and suction operation B) based on different recovery methods are set in accordance with initial color material concentration ranges, as shown in FIG. 5, and one of the recovery operations is selected and executed on the basis of the specified initial color material concentration. As shown in FIG. 5, if no discharge failure orifice is detected even after a predetermined number of times of non-discharge scanning, the initial color material concentration is low, and the recovery operation may be unnecessary. When the number of times of non-discharge scanning per discharge failure orifice detection is set small, and the number of times of discharge failure orifice detection is increased, the initial color material concentration can be specified in a narrower range, although the initial color material concentration specifying process takes a longer time.

The color material concentration (initial color material concentration) before execution of non-discharge scanning has been described above as the color material concentration to be specified. However, the color material concentration to be specified may be that after execution of the non-discharge scanning. As already described, the color material concentration after execution of non-discharge scanning is not always constant independently of the initial color material concentration. As the initial color material concentration becomes low, the color material concentration after execution of non-discharge scanning becomes low. Hence, when the number of times of non-discharge scanning until a discharge failure orifice is detected is obtained in advance by experiments and the like, the color material concentration can be obtained on the basis of the number of times of non-discharge scanning upon discharge failure orifice appearance. When a plurality of recovery operations are set in accordance with the color material concentrations, and one of the recovery operations is selected and executed on the basis of the specified color material concentration, ink discharging or sucking in a suitable amount is possible. That is, the color material concentration to be specified to enable ink discharging or sucking in a suitable amount may be that after execution of non-discharge scanning.

FIG. 1 is a flowchart of a process of specifying the color material concentration (initial color material concentration) in ink near the orifices before execution of non-discharge scanning in this embodiment. In this flowchart, a recovery operation corresponding to the specified initial color material concentration range is also executed.

In step S10, the printing apparatus 1 is powered on. The process of specifying the initial color material concentration according to this embodiment is automatically executed when the printing apparatus 1 is powered on.

In step S15, 0 is set to a total N number of times of non-discharge scanning. The total N number of times of non-discharge scanning is a value to store the number of times of non-discharge scanning from the start of the process up to detection of a discharge failure orifice in a discharge failure orifice detection step to be described later.

In step S20, the $n_1$ number of times of non-discharge scanning until the first detection is set as the $n_i$ number of times of non-discharge scanning until the ith detection of a discharge failure orifice of the printhead 3. The value $n_1$ is defined as the n number of times of non-discharge scanning executed in step S20. As already described, when a discharge failure orifice is detected in the first detection, and the set value $n_1$ is small, the initial color material concentration can be specified in a narrow range. Note that the printing apparatus 1 may set a predetermined fixed value as $n_1$. Alternatively, the operator may set an arbitrary value as $n_1$ from the printing apparatus 1 or the host 610 connected to it.

In step S30, non-discharge scanning is executed n times on the basis of the set value n.

In step S35, the sum of the total N number of times of non-discharge scanning and the n number of times of non-discharge scanning executed in step S20 is set as a new total N number of times of non-discharge scanning.

In step S40, it is detected whether the printhead 3 has a discharge failure orifice. To detect a discharge failure orifice in step S40, a conventionally known method is usable, though it is not limited to a specific detection method. For example, ink is discharged on an ink acceptor provided in the printing apparatus 1 so as to pass through the path of light emitted from a light-emitting element to a light-receiving element. It is detected whether the light is shielded or not. Alternatively, a test pattern is printed on the print medium P, and information concerning the reflectance optical density of the printed test pattern is acquired by a sensor or visually by the operator, thereby detecting a discharge failure orifice. In this embodiment, ink is discharged on an ink acceptor provided in the printing apparatus 1 so as to pass through the path of light emitted from a light-emitting element to a light-receiving element. It is detected whether the light is shielded or not. If at least one discharge failure orifice is detected, it is determined that a discharge failure orifice has appeared.

If no discharge failure orifice is detected in step S40, the process advances to step S50.

In step S50, a preset threshold value $N_0$ is compared with the total N number of times of non-discharge scanning set in step S35. If it is determined that $N>N_0$, i.e., if no discharge failure orifice is detected even when non-discharge scanning is executed more than the number of times set by the threshold value, the initial color material concentration is not so high as to cause degradation in print quality or ink supply failure. Hence, the process advances to step S110 to execute printing.

If $N \leqq N_0$ in step S50, the process of specifying the initial color material concentration is continued to execute the non-discharge scanning operation again. If it is determined in step S50 that $N \leqq N_0$, the process advances to step S55 to set the $n_i$ number of times of non-discharge scanning to be executed in step S30 before the ith (i is an integer of 2 or more) detection. The value $n_i$ is set to the n number of times of non-discharge scanning to be executed in step S30. As described above, when a discharge failure orifice is detected in the ith detection, and the set value $n_i$ is small, the initial color material concentration can be specified in a narrow range. Note that the printing apparatus 1 may set a predetermined fixed value as $n_i$. Alternatively, the operator may set an arbitrary value as $n_i$ from the printing apparatus 1 or the host 610 connected to it.

Note that the $n_1$, $n_2$, $n_3$, . . . , $n_i$ numbers of times of non-discharge scanning to be executed in step S30 may be set to the same value or different values. However, to discharge or suck ink in a suitable amount without degradation in print quality or ink supply failure, it is preferable to specify the concentration in a narrow range and finely set different recovery operations when the initial color material concentration is high. When the initial color material concentration is low, the recovery operations can be set more roughly than the case wherein the initial color material concentration is high. Hence, the $n_1$, $n_2$, $n_3$, . . . , $n_i$ numbers of times of non-discharge scanning to be executed in step S30 is preferably set to increase stepwise.

If it is determined in step S40 that a discharge failure orifice has appeared, the process advances to step S60.

In step S60, a preset threshold value $N_1$ ($N_1<N_0$) is compared with the total N number of times of non-discharge scanning. It is already determined before step S60 that the initial color material concentration is so high as to require a recovery operation before the start of printing because a discharge failure orifice in the printhead 3 is detected in step S40. When the total N number of times of non-discharge scanning is larger than the threshold value $N_1$, the initial color material concentration is specified as a concentration corresponding to the recovery operation (preliminary discharge operation A) with the minimum ink discharging or sucking amount in the recovery operations set in this process. If it is determined in step S60 that $N>N_1$, the process advances to step S70 to execute the preliminary discharge operation A. Then, printing starts in step S110.

If it is determined in step S60 that the total N number of times of non-discharge scanning is equal to or smaller than $N_1$, the process advances to step S80.

In step S80, a preset threshold value $N_2$ ($N_2<N_1$) is compared with the total N number of times of non-discharge scanning. If it is determined in step S80 that the total N number of times of non-discharge scanning is larger than $N_2$, the initial color material concentration is specified as a concentration corresponding to the suction operation A that is set to suck ink in a larger amount than the ink discharging amount of the preliminary discharge operation A. If it is determined that the total N number of times of non-discharge scanning is equal to or smaller than $N_2$, the initial color material concentration is specified as a concentration corresponding to the suction operation B that is set to suck ink in a larger amount than the ink suction amount of the suction operation A. If $N>N_2$, the process advances to step S90 to execute the suction operation A. Then, printing starts in step Silo. If $N \leqq N_2$, the process advances to step S100 to execute the suction operation B. Then, printing starts in step S110.

For steps S60 and S80, a table of the total N number of times of non-discharge scanning and initial color material concentration may be prepared and referred to, thereby specifying the initial color material concentration. In the above description, the suction ink amount of the suction operation B in step S100 is set to be larger than that of the suction operation A in step S90. However, the ink suction pressure may be set to be higher in the suction operation B than in the suction operation A while setting the same ink suction amount. Instead of the suction operation A in step S90, a preliminary discharge operation B with an ink discharging amount set to be larger than that of the preliminary discharge operation A may be executed.

The process of specifying the color material concentration (initial color material concentration) in ink near the orifices before execution of non-discharge scanning can be executed at any other timing than the power-on timing of the printing apparatus 1. For example, an instruction unit may be provided in the printing apparatus 1 or the host 610 connected to it. The process of specifying the initial color material concentration may freely be done in accordance with an operator instruction input through the instruction unit.

[Second Embodiment]

In the first embodiment, non-discharge scanning is executed, and the initial color material concentration is specified on the basis of the number of times of non-discharge scanning upon discharge failure orifice appearance. Additionally, it is possible to discharge or suck ink in a suitable amount without degradation in print quality or ink supply failure caused by a small ink discharging or sucking amount or without wasteful ink discharging or sucking by performing a recovery operation corresponding to the specified initial color material concentration range. In the second embodiment, a printhead 3 is separated from a capping mechanism 11 and held while exposing the orifices to air, and the initial color material concentration is specified on the basis of the hold time (to be also referred to as the air hold time hereinafter) until discharge failure orifice appearance. The same reference numerals as in the first embodiment denote the same components in the second embodiment, and a description thereof will be omitted.

As described in the first embodiment, discharge failure orifices appear due to the influence of evaporation and initial color material concentration in ink near the orifices. When the printhead 3 is separated from the capping mechanism 11 and held while exposing the orifices to air, ink near the orifices evaporate to generate discharge failure orifices. The relationship between the air hold time and the initial color material concentration is similar to that between the number of times of non-discharge scanning and the initial color material concentration. The lower the initial color material concentration is, the longer the air hold time is necessary until a discharge failure orifice appears. This is because when the initial color material concentration is low, a long time is required until ink near the orifices evaporates and obtains a predetermined color material concentration. To the contrary, if the initial color material concentration is high, a discharge failure orifice appears even when the air hold time is short. Hence, when the air hold time until discharge failure orifice appearance is obtained in advance in correspondence with each color material concentration by experiments and the like, the color material concentration can be specified from the air hold time upon discharge failure orifice appearance. When a recovery operation is executed in accordance with the specified initial color material concentration, ink discharging or sucking in a suitable amount is possible without degradation in print quality or ink supply failure caused by a small ink discharging or sucking amount or without wasteful ink discharging or sucking. When the air hold time per discharge failure orifice detection is set short, and the number of times of discharge failure orifice detection is increased, the initial color material concentration can be specified in a narrower range, although the initial color material concentration specifying process takes a longer time.

FIG. 6 is a flowchart of a process of specifying the color material concentration (initial color material concentration) in ink near the orifices before the printhead 3 is separated from the capping mechanism 11 and held while exposing the orifices to air in this embodiment. In this flowchart, a recovery operation corresponding to the specified initial color material concentration range is also executed.

In step S210, a printing apparatus 1 is powered on. The process of specifying the initial color material concentration according to this embodiment is automatically executed when the printing apparatus 1 is powered on.

In step S215, 0 is set to a total air hold time T. The total air hold time T is a value to store the air hold time from the start of the process up to detection of a discharge failure orifice in a discharge failure orifice detection step to be described later.

In step S220, an air hold time $t_1$ until the first detection is set as an air hold time $t_i$ until the ith detection of a discharge failure orifice of the printhead 3. The value $t_1$ is defined as a time t of air hold executed in step S220. As already described, when a discharge failure orifice is detected in the first detection, and the set value $t_1$ is small, the initial color material concentration can be specified in a narrow range. Note that the printing apparatus 1 may set a predetermined fixed value as $t_i$. Alternatively, the operator may set an arbitrary value as $t_i$ from the printing apparatus 1 or a host 610 connected to it.

In step S230, the printhead 3 is held while exposing the orifices to air for t sec on the basis of the set value t.

In step S235, the sum of the total air hold time T and the air hold time t in step S220 is set as a new total air hold time T.

In step S240, it is detected whether the printhead 3 has a discharge failure orifice. The discharge failure orifice detection method is the same as in the above-described embodiment.

If no discharge failure orifice is detected in step S240, the process advances to step S250.

In step S250, a preset threshold value $T_0$ is compared with the total air hold time T set in step S235. If it is determined that $T>T_0$, i.e., if no discharge failure orifice is detected even when the orifices are exposed to air for a time longer than that set by the threshold value, the initial color material concentration is not so high as to cause degradation in print quality or ink supply failure. Hence, the process advances to step S310 to execute printing.

If $T \leqq T_0$ in step S250, the process of specifying the initial color material concentration is continued to execute the operation of holding the printhead 3 while exposing the orifices to air again. If it is determined in step S250 that $T \leqq T_0$, the process advances to step S255 to set the time $t_i$ of air hold to be executed in step S230 before the ith (i is an integer of 2 or more) detection. The value $t_i$ is set to the time t of air hold to be executed in step S230. When a discharge failure orifice is detected in the ith detection, and the set value $t_i$ is small, the initial color material concentration can be specified in a narrow range.

Note that the times $t_1, t_2, t_3, \ldots, t_i$ of air hold to be executed in step S230 may be set to the same value or different values. However, to discharge or suck ink in a suitable amount without degradation in print quality or ink supply failure, it is preferable to specify the concentration in a narrow range and finely set different recovery operations when the initial color material concentration is high. When the initial color material concentration is low, the recovery operations can be set more roughly than the case wherein the initial color material concentration is high. Hence, the times $t_1, t_2, t_3, \ldots, t_i$ of air hold to be executed in step S230 is preferably set to become longer stepwise.

If it is determined in step S240 that a discharge failure orifice has appeared, the process advances to step S260.

In step S260, a preset threshold value $T_1$ ($T_1<T_0$) is compared with the total air hold time T. It is already determined before step S260 that the initial color material concentration is so high as to require a recovery operation before the start of printing because a discharge failure orifice in the printhead 3 is detected in step S240. When the total air hold time T is more than the threshold value $T_1$, the initial color material concentration is specified as a concentration corresponding to the recovery operation (preliminary discharge operation A) with the minimum ink discharging or sucking amount in the recovery operations set in this process. If it is determined in step S260 that $T>T_1$, the process advances to step S270 to execute the preliminary discharge operation A. Then, printing starts in step S310.

If it is determined in step S260 that the total air hold time T is equal to or less than $T_1$, the process advances to step S280.

In step S280, a preset threshold value $T_2$ ($T_2<T_1$) is compared with the total air hold time T. If it is determined in step S280 that the total air hold time T is more than $T_2$, the initial color material concentration is specified as a concentration corresponding to the suction operation A that is set to suck ink in a larger amount than the ink discharging amount of the preliminary discharge operation A. If it is determined that the total air hold time T is equal to or less than $T_2$, the initial color material concentration is specified as a concentration corresponding to the suction operation B that is set to suck ink in a larger amount than the ink suction amount of the suction operation A. If $T>T_2$, the process advances to step S290 to execute the suction operation A. Then, printing starts in step S310. If $T\leqq T_2$, the process advances to step S300 to execute the suction operation B. Then, printing starts in step S310.

For steps S260 and S280, a table of the total air hold time T and initial color material concentration may be prepared and referred to, thereby specifying the initial color material concentration. The process of specifying the initial color material concentration can be executed at any other timing than the power-on timing of the printing apparatus 1. For example, an instruction unit may be provided in the printing apparatus 1 or the host 610 connected to it. The process of specifying the initial color material concentration may freely be done in accordance with an operator instruction input through the instruction unit. When the printhead 3 is separated from the capping mechanism 11 and held while exposing the orifices to air, the printhead 3 may be at rest. On the other hand, when the printhead 3 is scanned in the main scanning direction, ink near the orifices evaporates quickly, and the process of specifying the initial color material concentration can be executed in a shorter time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-320871, filed Nov. 28, 2006, which is hereby incorporated by reference herein in its entirety.

What is claimed is:

1. A printing apparatus for executing printing by scanning a printhead having an orifice to discharge ink, the apparatus comprising:

a scanning unit configured to reciprocally scan the printhead without discharging ink for a plurality of times;

a detection unit configured to detect a discharging condition of the printhead;

a control unit configured to perform a discharge detection for controlling the detection unit to detect the discharging condition of the printhead after controlling the scanning unit to perform the scanning, and repeat the discharge detection until the detection unit detects a discharge failure;

a recovery unit configured to recover the printhead; and a recovery control unit configured to control the recovery unit based on a number of times the discharge detection is performed.

2. The apparatus according to claim 1, wherein said detection unit executes detection of the discharging condition by stepwise increasing the number of times of scanning without discharging the ink from a first discharge detection to a next discharge detection.

3. A control method for a printing apparatus which prints by scanning a printhead having an orifice to discharge ink, the method comprising:

reciprocally scanning the printhead without discharging ink for a plurality of times;

detecting a discharging condition of the printhead;

performing a discharge detection for controlling the detecting step to detect the discharging condition of the printhead after controlling the scanning step to perform the scanning, and repeating the discharge detection until the detecting step detects a discharge failure; and controlling recovery of the printhead based on a number of times the discharge detection is performed.

4. A printing apparatus comprising:

a moving unit configured to move a printhead having an orifice to discharge ink;

a detection unit configured to detect a state of the orifice;

a control unit configured to perform a discharge detection for controlling the detection unit to detect the state of the orifice after controlling the moving unit to move the printhead without discharging ink, and repeat the discharge detection until the detection unit detects a discharge failure state of the orifice;

a recovery unit configured to recover the printhead; and a recovery control unit configured to control the recovery unit based on a number of times the discharge detection is performed.

5. The printing apparatus according to claim 4, wherein the control unit stepwise increases a number of times for which the moving unit moves the printhead after the moving unit has previously moved the printhead.

* * * * *